United States Patent [19]

Ward

[11] 4,222,694

[45] Sep. 16, 1980

[54] INDUSTRIAL WORKPIECE TRANSPORTING CAR SYSTEM

[75] Inventor: Frederick W. A. Ward, Warren, Ohio

[73] Assignee: Wean United, Inc., Pittsburgh, Pa.

[21] Appl. No.: 933,354

[22] Filed: Aug. 14, 1978

[51] Int. Cl.[3] ..... B60P 3/00

[52] U.S. Cl. ..... 410/45; 104/300; 105/96

[58] Field of Search ..... 105/367, 215 R, 215 C, 105/96; 104/147 R, 152, 153 R; 410/45

[56] References Cited

U.S. PATENT DOCUMENTS 3,658,011 4/1972 West et al. ..... 410/45

*Primary Examiner*—Richard A. Bertsch

*Attorney, Agent, or Firm*—Daniel Patch; Suzanne Kikel

[57] ABSTRACT

This disclosure pertains to a self-propelled industrial car for use in transporting hot or cold rolled steel coils having two pair of non-flanged wheels engageable with a track or flat surface, the guiding thereof being affected by a pair of guide rollers for each pair of wheels received in a guiding slot.

7 Claims, 4 Drawing Figures

INDUSTRIAL WORKPIECE TRANSPORTING CAR SYSTEM

The present invention relates to a self-propelled industrial vehicle such as employed in the basic steel industries for supporting steel slabs and steel rolled coils between two plant facilities, such as in the case of coils, from the hot rolling mill to the continuous pickling facility.

In the more distant past coils were transferred by several different modes such as conveyors and industrial trucks. In more recent years, because of the substantial increase in the weight of the rolled coils, separate cars were employed. An example of such a car is illustrated in U.S. Pat. No. 3,658,011 dated Apr. 25, 1972 entitled, "Coil Cars". Such cars, however, were very expensive to manufacture and operate and were individually built for a more or less single plant operation. One of the primary items of expense had reference to the number and the design of the wheel assemblies and the mechanical driving components thereof.

The single or individual purpose of past cars was found in the fact that they were designed to only operate on tracks or rails and hence could not be used with flat backed up supporting surfaces for the wheels, nor could the wheels run over the plant or mill floors.

It is therefore an object of the present invention to provide an industrial workpiece supporting car of the general type referred to above that will be economical to manufacture and operate and easily adaptable for several different usages and to different modes of supporting its wheels.

A still further object of the present invention is to provide in an industrial car system for carrying and transporting a workpiece, a transporting car adapted for use on tracks or floor surface and the like comprising: a cradle frame having a supporting surface for carrying a workpiece, said cradle frame having supportable means each including load transferring surfaces, a truck assembly for each supportable means of said cradle frame arranged beneath an associated supportable means, said truck assemblies each including means for transferring the load of said supportable means of said cradle frame to said truck assemblies in a manner that permits relative movement between said truck assemblies and said load transferring surfaces of said supportable means, a pair of supporting wheels for each truck assembly having non-flanged supporting surfaces arranged to contact said tracks or floor surface, at least one pair being driven, guiding means for each truck assembly secured thereto and wherein said system further comprises restraining means constructed and arranged to receive said guiding means for controlling the course of travel of said transporting car.

These objects, as well as other novel features and advantages of the present invention, will be better understood when the following description of a preferred embodiment thereof is read along with the accompanying drawings of which:

Figure 1:
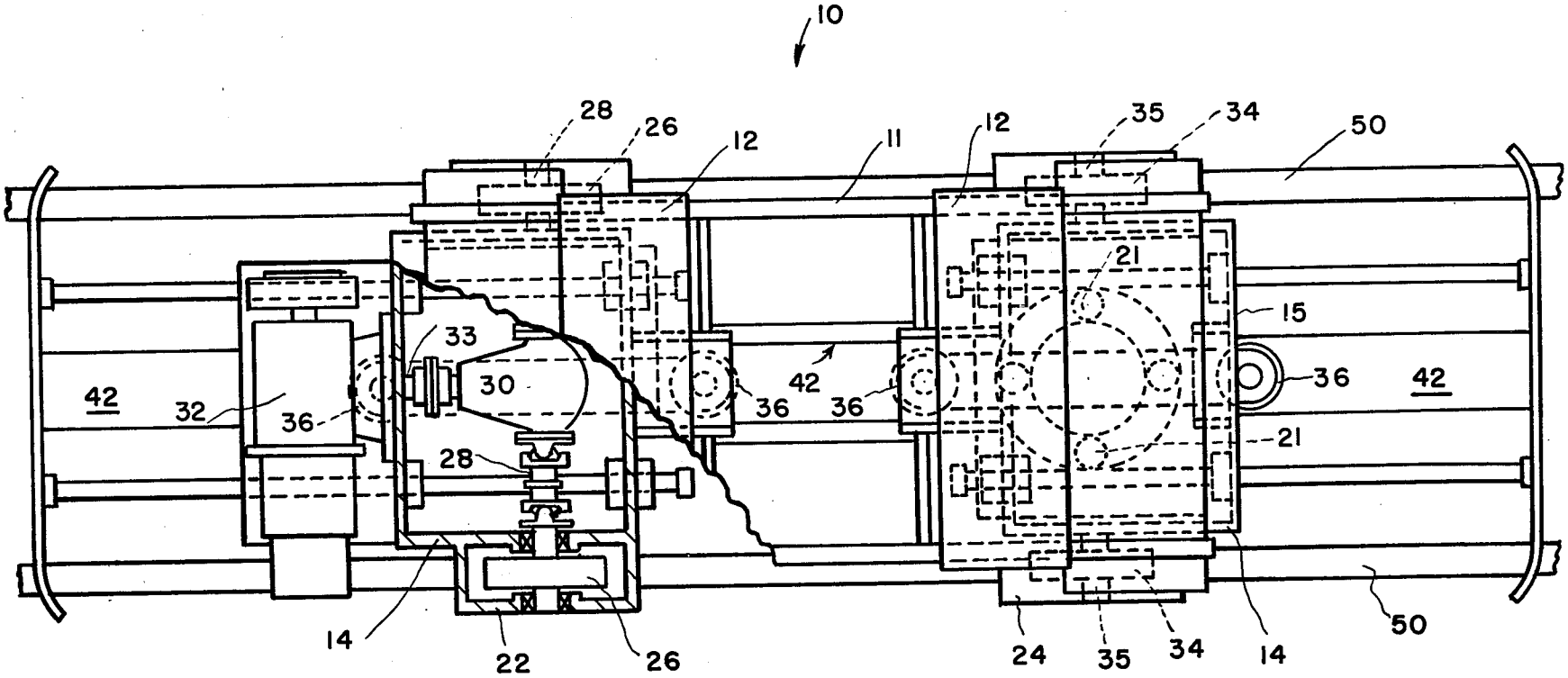
FIG. 1 is a plan view, partly in section, of an industrial car system built in accordance with the present invention.
Figure 2:
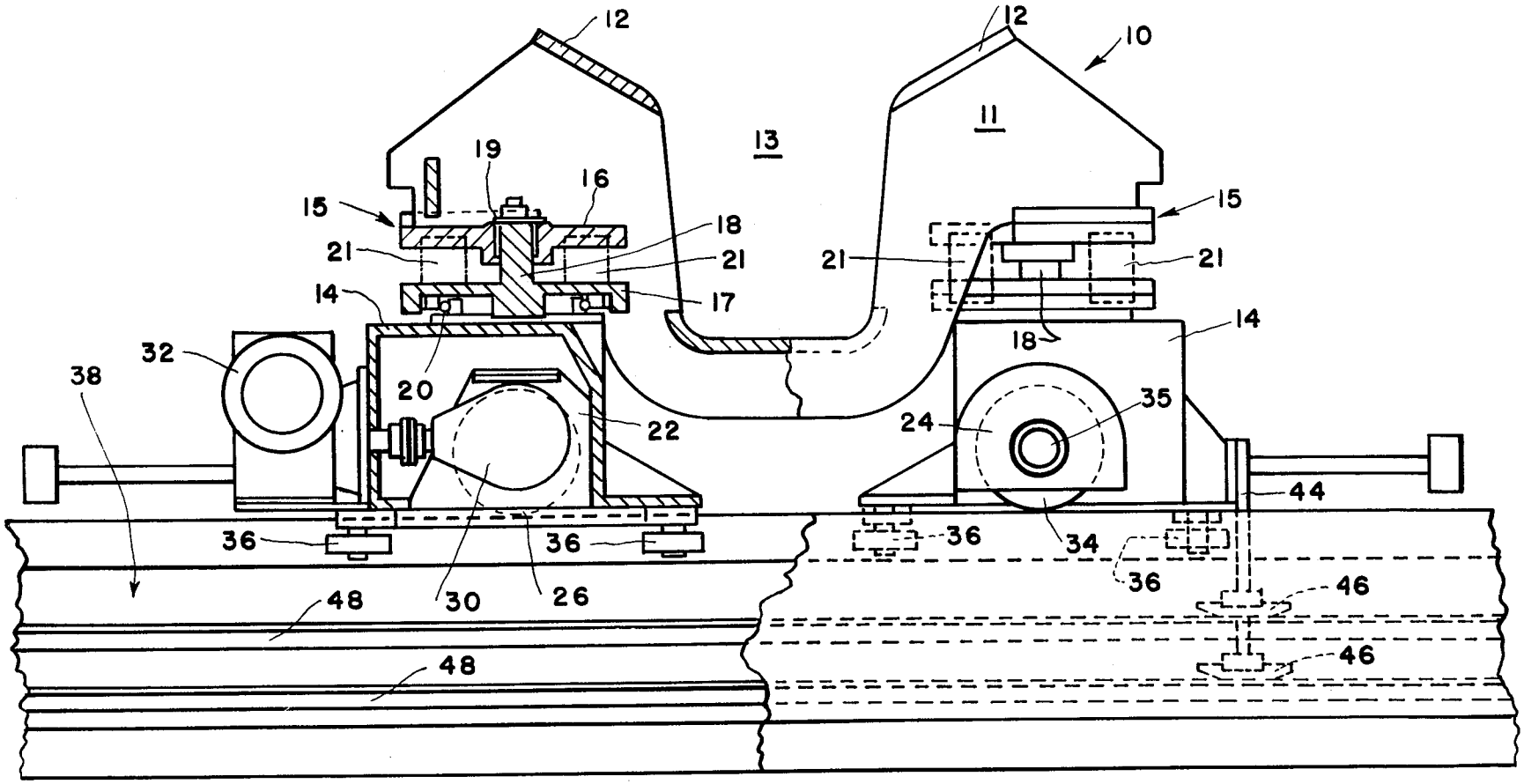
FIG. 2 is a side elevational view, partly in section, of the car system illustrated in FIG. 1.
Figure 3:
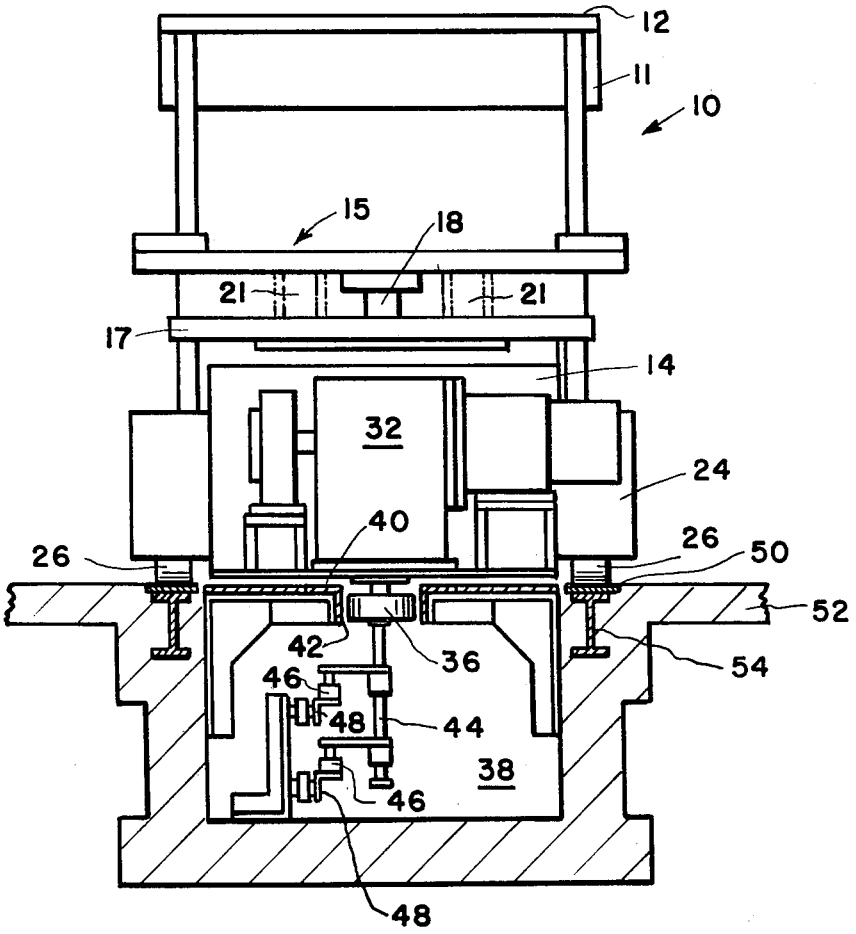
FIG 3 is an end elevational view, partly in section, of the car system shown in FIGS. 1 and 2 and wherein the wheels of the transfer car are supported by flat back up plates.

In referring to FIGS. 1, 2 and 3, there is illustrated a self-propelled coil car 10, comprising a U-shaped cradle 11 having opposed coil supporting surfaces 12 separated by an opening 13. These supports 12 along with the opening 13 are designed to facilitate a range of coil sizes having different widths and diameters. As noted previously, a number of similar cars are especially designed to serve very heavy hot or cold rolled steel coils and transfer them between different stations, departments or buildings.

The cradle 11 is supported at its two opposite ends by two frames 14. On the respective adjacent portions of the cradle and frames there are provided shock absorbing and bearing devices 15, each consisting of an upper retaining plate 16 and a lower retaining plate 17 having a centrally arranged pivot pin or spindle 18, for receiving the upper plate 16. The plates are carried by the cradle and frame in some convenient manner, not shown. A vertically arranged bearing 19 is mounted between the adjacent surfaces of the spindle 18 and the plate 16 and a horizontally arranged bearing 20 is arranged between the inside surface of the plate 17 and the top of the frame 14 so that the two plates 16 and 17 are permitted to move relative to each other and the cradle 11 is permitted to move in the vertical plane as necessitated by the weight of the coil as it is placed on or taken off the car 10. Also by the same construction the two frames 14 are permitted to rotate in the horizontal plane relative to the cradle 11, which is required when the tracks of the car are curved. Between the outer extremeties of the plates 16 and 17 there are arranged in a vertical position a number of compression springs 21 or other force absorbing devices such as hydraulic or pneumatic piston cylinder assemblies which absorb the weight of the coil as transferred from the cradle to the plate 16 and hence to the springs or other shock absorbing devices.

Each frame 14 makes up part of a front or rear truck assembly 22 and 24. The truck assembly 22 is a driven assembly while the truck assembly 24 is non-driven. The assembly 22 includes a pair of non-flanged wheels 26 having axles 28 that pass into a gear differential unit 30, the differential unit being driven by an electrical motor 32 through a shaft 33. The rear truck assembly 24 also has non-flanged wheels 34 each having stub axles 35 that allow the wheels to rotate freely.

Since the car is provided with non-flanged wheels the necessary guiding or steering of the car is accomplished by a network of guiding rolls 36 arranged beneath each frame assembly 14. Each truck assembly 22/24 is provided with a pair of centrally arranged guide rollers 36 best shown in FIG. 3 projecting downwardly from each frame 14 into a pit 38, best shown in FIG. 3, into which is received a cooperative pair of guide tracks 40 which form a slot 42. The tracks 40 extend between two stations between which the car 10 travels. It is important to point out that the unit consisting of the two guide rollers 36 are mounted on the center of the tracks 40 with respect to one plane and also on the centers of the axes 28 and 35 with respect to a second plane of their respective trucks 22 and 24. This assures that the guide rollers are maintained equal distance on either side of the center line of the axes of the pivot pins 18. The guide rollers of each assembly being rigidly secured to the axle function as a swivel piece, i.e., the two cooperative guide rollers each rigidly connected to the axle translate their guiding influence directly to the wheels of the associated truck assembly. Thus any movement of the guide rollers caused by the guiding influence of the tracks 40 is immediately translated to the wheels. This construction therefore in effect reacts as a steering mechanism in whatever path or curve may be taken by the tracks 40. The center line between the two guide rollers present a line parallel to the tangent of the curve of the slot 42 for the guide rollers. In this manner the axles supporting the guide rollers are always kept at right angles to the tangent of the guiding slot 42 and the rollers 36 are allowed to rotate freely without being subject to any drag or side stresses.

FIGS. 1 and 3 also illustrate the power supply system for the car 10. Extending downwardly from the rear frame 14 into the slot 42 is an arm 44 having two vertically spaced contact shoes 46. These shoes engage electrically charged rails 48, one being the ground and the other being the hot rail. In view of the guiding arrangement provided for the car 10 it is important that the arm 44 be arranged as close to the adjacent guiding roller 36 as possible to assure that continuous contact will be maintained between the shoes 46 and the electrical rail 48. In still referring to FIG. 3 it will be noted that the non-flanged wheels 26 ride on flat steel plates 50 imbedded in the floor 52 in which, due to the heavy weight of the coils the plates are , in this case, backed up by I-beams 54.

Figure 4:
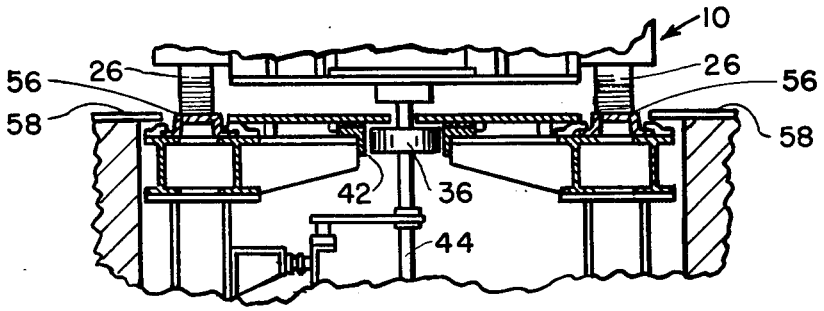
FIG. 4 is a partial view similar to FIG. 3 illustrating a second embodiment of the invention wherein the wheels of the transfer car are supported by rails or tracks.

Turning now to FIG. 4, wherein the lower portion of the car 10 is only shown it will be noted that in this case the non-flanged wheels 26 are supported by rails or tracks 56, the upper surface of which are flush with the floor 58. As noted above, in other applications the car can be used directly on the floor in which case it may be desirable to rubberize the non-flanged wheels. It will be appreciated that while the disclosed car has been described as a coil car, the car can just as well be employed to handle other workpieces, such as, in the context of producing steel objects, steel slabs as produced by a slab mill, or a continuous caster.

In accordance with the provisions of the patent statutes, I have explained the principle and operation of my invention and have illustrated and described what I consider to represent the best embodiment thereof.

I claim:

1. In an industrial car system for carrying and transporting a workpiece, a transporting car adapted for use on tracks or floor surface and the like comprising:

a cradle frame having a supporting surface for carrying a workpiece, said cradle frame having supportable means each including load transferring surfaces, a truck assembly for each supportable means of said cradle frame arranged beneath an associated supportable means, said truck assemblies each including means for transferring the load of said supportable means of said cradle frame to said truck assemblies in a manner that permits relative movement between said truck assemblies and said load transferring surfaces of said supportable means, a pair of supporting wheels for each truck assembly having non-flanged supporting surfaces arranged to contact said tracks or floor surface, at least one pair being driven, guiding means for each truck assembly secured thereto, and wherein said system further comprises restraining means constructed and arranged to receive said guiding means for controlling the course of travel of said transporting car.

2. In an industrial car system according to claim 1, wherein said guide means and said restraining means have planes passing through their respective centers that are coincidentally arranged in the direction of the travel of the car, an axle means for each truck assembly for connecting an associated pair of wheels, means for mounting said guide means for each truck assembly so that said plane thereof intersects the mid-point of the distance between an associated pair of wheels.

3. In an industrial car system according to claim 2 wherein said guide means includes two rollers for each truck assembly spacedapart along said plane thereof, said restraining means includes a guide slot for receiving said rollers, means for securing said rollers to an associated truck assembly in a manner that they are rigid with an associated axle means and an equal distance from an associated axle means whereby said axle means of each truck assembly is maintained perpendicularly to said guiding slot at the point of tangency thereof.

4. In an industrial car system according to claim 3 having electrical power means for driving said transporting car and arranged as an integral part of said car, an electrical contact means carried by said car projectable into said guiding slot, means spaced from said guide rollers for supplying electrical power to said contact means, means for mounting said contact means closely adjacent to one of said rollers and to said plane to thereby minimize movement of the contact means relative to the means for supplying electrical power that would take them out of contact.

5. In an industrial car system according to claim 1, wherein said tracks are arranged to run along the floor of the plant and wherein said means for transferring the load of said supportable means of said cradle frame includes for each truck assembly a cooperative pair of vertically and horizontally arranged anti-friction bearings.

6. In an industrial car system according to claim 5 wherein each said truck assembly includes a box-like frame, means in each said frame for receiving an axle means for said pairs of wheels thereof, each said frame having members for receiving said horizontally arranged bearings, and wherein said supportable means of said cradle frame includes means for receiving said vertically arranged bearings.

7. In an industrial car system according to claim 6 wherein said transporting car includes a power means and a differential gear unit constructed and arranged to drive said axle means for the pair of wheels for one of said truck assemblies, and means for mounting for free rotation the pair of wheels of said other truck assembly on an associated axle means.

* * * * *